US009757870B2

(12) United States Patent
Giannopoulos et al.

(10) Patent No.: US 9,757,870 B2
(45) Date of Patent: Sep. 12, 2017

(54) SHAVER

(71) Applicant: BIC-VIOLEX SA, Anixi, Attiki (GR)

(72) Inventors: Panagiotis Giannopoulos, Ilion (GR); Panagiotis Zafiropoulos, Wallingford, CT (US); Ioannis Bozikis, Koukaki (GR)

(73) Assignee: BIC VIOLEX S.A., Anixi (GR)

( * ) Notice: Subject to any disclaimer, the term of this patent is extended or adjusted under 35 U.S.C. 154(b) by 107 days.

(21) Appl. No.: 14/646,851

(22) PCT Filed: Dec. 21, 2012

(86) PCT No.: PCT/EP2012/076802
§ 371 (c)(1),
(2) Date: May 22, 2015

(87) PCT Pub. No.: WO2014/094907
PCT Pub. Date: Jun. 26, 2014

(65) Prior Publication Data
US 2015/0314465 A1 Nov. 5, 2015

(51) Int. Cl.
*B26B 21/14* (2006.01)
*B26B 21/52* (2006.01)
*B26B 21/22* (2006.01)

(52) U.S. Cl.
CPC ..... *B26B 21/521* (2013.01); *B26B 21/14* (2013.01); *B26B 21/222* (2013.01); *B26B 21/225* (2013.01); *B26B 21/227* (2013.01)

(58) Field of Classification Search
CPC ..... B26B 21/14; B26B 21/222; B26B 21/225; B26B 21/227; B26B 21/521; B26B 21/4012
USPC ..... 30/47–51, 526, 527
See application file for complete search history.

(56) References Cited

U.S. PATENT DOCUMENTS 3,644,992 A * 2/1972 Bennett ..... B26B 21/165 30/64
3,935,639 A * 2/1976 Terry ..... B26B 21/225 30/47
3,950,849 A * 4/1976 Perry ..... B26B 21/225 30/47
4,083,104 A * 4/1978 Nissen ..... B26B 21/521 30/47
4,094,063 A * 6/1978 Trotta ..... B26B 21/521 30/47
4,245,389 A * 1/1981 Trotta ..... B26B 21/16 30/47

(Continued)

FOREIGN PATENT DOCUMENTS

GB 2 471 676 A 1/2006
GB 2 452 411 A 3/2009

(Continued)

OTHER PUBLICATIONS

International Report of PCT/EP2012/076802; dated Sep. 6, 2013.

*Primary Examiner* — Jason Daniel Prone
(74) *Attorney, Agent, or Firm* — Polsinelli PC

(57) ABSTRACT

A shaver comprising a handle with an elongated handgrip portion and a mounting portion, a shaver head attached to the mounting portion, the shaver head having a back structure. A removable cartridge is attached to the shaver head through an elastic member provided on the back structure of the shaver head.

19 Claims, 8 Drawing Sheets

(56) References Cited

U.S. PATENT DOCUMENTS 4,253,236 A * 3/1981 Jacobson ..... B26B 21/521 30/47
4,282,650 A * 8/1981 Trotta ..... B26B 21/521 30/47
4,282,651 A * 8/1981 Trotta ..... B26B 21/521 30/532
4,347,663 A * 9/1982 Ullmo ..... B26B 21/225 30/47
4,446,619 A * 5/1984 Jacobson ..... B26B 21/521 30/47
4,599,793 A * 7/1986 Iten ..... B26B 21/225 30/47
4,780,959 A * 11/1988 Sinka ..... B26B 21/4018 30/47
5,016,352 A * 5/1991 Metcalf ..... B26B 21/225 30/47
5,044,077 A * 9/1991 Ferraro ..... B26B 21/225 30/47
5,347,717 A * 9/1994 Ts'ai ..... B26B 21/225 30/50
5,669,139 A * 9/1997 Oldroyd ..... B26B 29/00 30/47
5,933,960 A * 8/1999 Avidor ..... B26B 19/30 30/51
5,953,825 A * 9/1999 Christman ..... B26B 21/225 30/50
6,115,924 A * 9/2000 Oldroyd ..... B26B 21/225 30/57
6,185,823 B1 * 2/2001 Brown ..... B26B 21/00 30/50
6,311,400 B1 * 11/2001 Hawes ..... B26B 21/225 30/50
6,425,184 B1 * 7/2002 Min ..... B26B 21/225 30/51
6,557,265 B2 * 5/2003 Coffin ..... B26B 21/225 30/50
6,560,881 B2 * 5/2003 Coffin ..... B26B 21/222 30/50
6,671,961 B1 * 1/2004 Santhagens Van Eibergen ..... B26B 21/227 30/50
7,140,116 B2 * 11/2006 Coffin ..... B26B 21/28 30/527
7,200,942 B2 * 4/2007 Richard ..... B26B 21/225 30/526
7,266,895 B2 * 9/2007 Pennella ..... B26B 21/222 30/47
7,540,088 B2 * 6/2009 Takeshita ..... B26B 21/4012 30/77
7,574,809 B2 * 8/2009 Follo ..... B26B 21/225 30/50
7,607,230 B2 * 10/2009 Aviza ..... B26B 21/4068 30/50
7,685,720 B2 * 3/2010 Efthimiadis ..... B26B 21/225 30/527
7,690,122 B2 * 4/2010 Worrick, III ..... B26B 21/222 30/50
7,703,361 B2 * 4/2010 Johnson ..... B26B 21/44 30/50
8,033,023 B2 * 10/2011 Johnson ..... B26B 21/222 30/50
8,046,920 B2 * 11/2011 Nakasuka ..... B26B 21/227 30/50
8,166,661 B2 * 5/2012 King ..... A45D 27/225 30/50
8,191,263 B2 * 6/2012 Follo ..... B26B 21/44 30/57
8,307,553 B2 * 11/2012 Follo ..... B26B 21/225 30/50
8,327,546 B2 * 12/2012 Tucker ..... B26B 21/225 30/50
8,359,751 B2 * 1/2013 Efthimiadis ..... B26B 21/222 30/50
8,381,406 B2 * 2/2013 Miyazaki ..... B26B 21/225 30/51
8,407,900 B2 * 4/2013 Johnson ..... B26B 21/4012 30/50
8,479,398 B2 * 7/2013 Coresh ..... B26B 21/22 30/50
8,499,459 B2 * 8/2013 Efthimiadis ..... B26B 21/225 30/50
8,584,344 B2 * 11/2013 Peterson ..... B26B 21/225 30/346.58
8,671,577 B2 * 3/2014 Brown ..... B26B 21/225 30/50
8,732,965 B2 * 5/2014 Efthimiadis ..... B26B 21/521 30/526
8,973,272 B2 * 3/2015 Moon ..... B26B 21/225 30/50
9,469,038 B2 * 10/2016 Iaccarino ..... B26B 21/225 30/50
9,486,930 B2 * 11/2016 Provost ..... B26B 21/225 30/50
9,694,503 B2 * 7/2017 Papadopoulos-Papageorgis ..... B26B 21/521 30/50
2002/0066186 A1 * 6/2002 White ..... B26B 21/58 30/50
2002/0189112 A1 * 12/2002 Peyser ..... B26B 21/521 30/50
2003/0079348 A1 * 5/2003 Follo ..... B26B 21/225 30/50
2004/0181953 A1 * 9/2004 Follo ..... B26B 21/521 30/527
2005/0011073 A1 * 1/2005 Sandor ..... A61K 8/361 30/50
2006/0080838 A1 4/2006 Johnson et al.
2006/0260131 A1 * 11/2006 Follo ..... B26B 21/225 30/50
2008/0256800 A1 * 10/2008 Nicoll ..... B26B 21/222 30/50
2008/0256802 A1 * 10/2008 O'Connor ..... B26B 21/4012 30/50
2011/0088269 A1 * 4/2011 Walker, Jr. ..... B26B 21/225 30/527
2011/0252646 A1 * 10/2011 Gordon ..... B26B 21/225 30/47
2014/0165800 A1 * 6/2014 Griffin ..... B26B 21/225 30/531
2014/0245613 A1 * 9/2014 Good ..... B26B 21/222 30/50
2014/0259675 A1 * 9/2014 Tucker ..... B26B 21/4031 30/50
2015/0158191 A1 * 6/2015 Jeong ..... B26B 21/4018 30/50
2015/0190935 A1 * 7/2015 Griffin ..... B26B 21/225 30/50
2015/0266192 A1 * 9/2015 Coresh ..... B26B 21/521 30/526
2015/0290819 A1 * 10/2015 Giannopoulos ..... B26B 21/222 30/532
2015/0290822 A1 * 10/2015 Haba ..... B26B 21/225 30/526
2015/0306777 A1 * 10/2015 Georgakis ..... B26B 21/222 30/51
2015/0314466 A1 * 11/2015 Papadopoulos-Papageorgis ..... B26B 21/222 30/532
2015/0321366 A1 * 11/2015 Papadopoulos-Papageorgis ..... B26B 21/222 30/532
2016/0001455 A1 * 1/2016 Swenson ..... B26B 21/225 30/57

(56) References Cited

U.S. PATENT DOCUMENTS

| | | | | |
|---|---|---|---|---|
| 2016/0129603 | A1* | 5/2016 | Antoniou | B26B 21/44<br>30/50 |
| 2016/0250764 | A1* | 9/2016 | Hashimoto | B26B 21/521<br>30/50 |
| 2017/0036363 | A1* | 2/2017 | Efthimiadis | B26B 21/52<br>30/527 |

FOREIGN PATENT DOCUMENTS

| | | | | |
|---|---|---|---|---|
| GR | CA 2945100 | A1 * | 10/2015 | B26B 21/52 |
| GR | WO 2015158382 | A1 * | 10/2015 | B26B 21/52 |
| WO | WO 93/10946 | | 6/1993 | |

* cited by examiner

SHAVER

This application is a national stage application of International Application No. PCT/EP2012/076802, filed on Dec. 21, 2012, the entire contents of which are incorporated herein by reference.

FIELD OF INVENTION

The embodiments of the present invention relates to a shaver with interchangeable cartridges, and to cartridges and head and handle assemblies for such shavers.

More particularly, the embodiments of the present invention relate to a shaver that includes:

a handle with an elongated body terminating in a mounting portion for retaining a shaver head, a shaver head adapted to accommodate an interchangeable shaving cartridge, a lock-and-release mechanism to enable the interchangeable shaving cartridge to be loaded and ejected from the shaver head, and an interchangeable cartridge containing one or more blades.

Such a shaver enables the user to replace the cartridge once the blade or blades become worn, while the handle and the shaver head can be kept and reused.

BACKGROUND OF THE INVENTION

The removal from the shaver head of the interchangeable blade cartridges, such as those disclosed in e.g. EP2195145, usually requires the user to press or pull the cartridge to actually displace the cartridge. This means that to replace the cartridge, the user needs to encounter the cartridge by his/her fingers. Therefore the risk of the injury of the user is increased.

SUMMARY OF THE INVENTION

An object of the present invention is to provide a shaver that includes a handle with an elongated handgrip portion and a mounting portion, a shaver head, the shaver head being attached to the mounting portion, the shaver head having a back structure, a removable cartridge, the cartridge comprising at least one blade, the cartridge being adapted to be attached to the shaver head and removed from the shaver head, and at least one elastic member provided on the back structure of the shaver head, the elastic member being adapted to attach the cartridge to the shaver head by snap-fitting.

In some embodiments, one may also use one or more of the following features:

the shaver head may be attached pivotally to the mounting portion, the elastic member comprises a flat central portion, a bottom portion, an end portion, and an extending part, wherein the bottom portion and the end portion protrude from the flat central portion, the bottom portion and the end portion of the elastic member are interconnected by the extending part, the elastic member is made of metal, the elastic member is a leaf spring, the cartridge is ejected in a direction perpendicular to the direction of shaving, the back structure of the shaver head further comprises an elastic member holder, adapted to accommodate and support the elastic member, the shaver head further comprises a bottom wall and a guard member, the guard member being positioned adjacent the bottom wall, the cartridge comprises at least one holder, and wherein the extending part of the elastic member is, upon insertion of the cartridge, snap-fitted to the at least one holder of the cartridge, the handle further comprises a slidable button, the button comprising a pusher, the pusher being adapted to encounter the at least one holder and thus release the cartridge from the shaver head.

In another aspect of the present invention, a cartridge is provided. The cartridge comprises a top wall, a bottom wall, and at least one holder, wherein the holder extends between the top wall and the bottom wall. In some embodiments, the one or more of the following features may be used:

the cartridge comprises a pair of holders, the pair of holders being provided in a form of a pair of parallel bars, the cartridge further comprises a top wall and a shaving aid, the shaving aid being provided in the top wall, the cartridge comprises at least one blade, and wherein the at least one blade is mounted movably.

In yet another aspect of the present invention, a head and handle assembly for a shaver is provided, the head and handle assembly comprising a handle with an elongated handgrip portion and a mounting portion, a shaver head, the shaver head being attached to the mounting portion, the shaver head being adapted to receive a cartridge, the shaver head having a back structure, and an elastic member provided on the back structure of the shaver head, the elastic member being adapted to attach the cartridge to the shaver head.

The head and handle assembly may further use one or more of the following features:

the shaver head may be attached pivotally to the shaver head, the elastic member comprises a flat central portion, a bottom portion, an end portion, and an extending part, wherein the bottom portion and the end portion protrude from the flat central portion, the bottom portion and the end portion of the elastic member are interconnected by the extending part, the shaver head further comprises a bottom wall and a guard member, the guard member being positioned adjacent the bottom wall.

With these features, the structure of the shaver head and the cartridge is simplified and thus the manufacturing costs are reduced. Moreover, as only the cartridge is replaced when the blades become worn, instead of replacing the whole shaver head, the costs of such shaver are kept lower, the resiliency and lifetime of the shaver head and the handle are increased. Further, as only the cartridge is replaced, the shaver is both easier to manufacture and more environment friendly, as the amount of material to be replaced (and disposed of) is reduced.

BRIEF DESCRIPTION OF THE DRAWINGS

Other characteristics and advantages of the invention will readily appear from the following description of one of its embodiments, provided as a non-limitative examples, and of the accompanying drawings.

On the drawings.

DETAILED DESCRIPTION

Figure 1A:
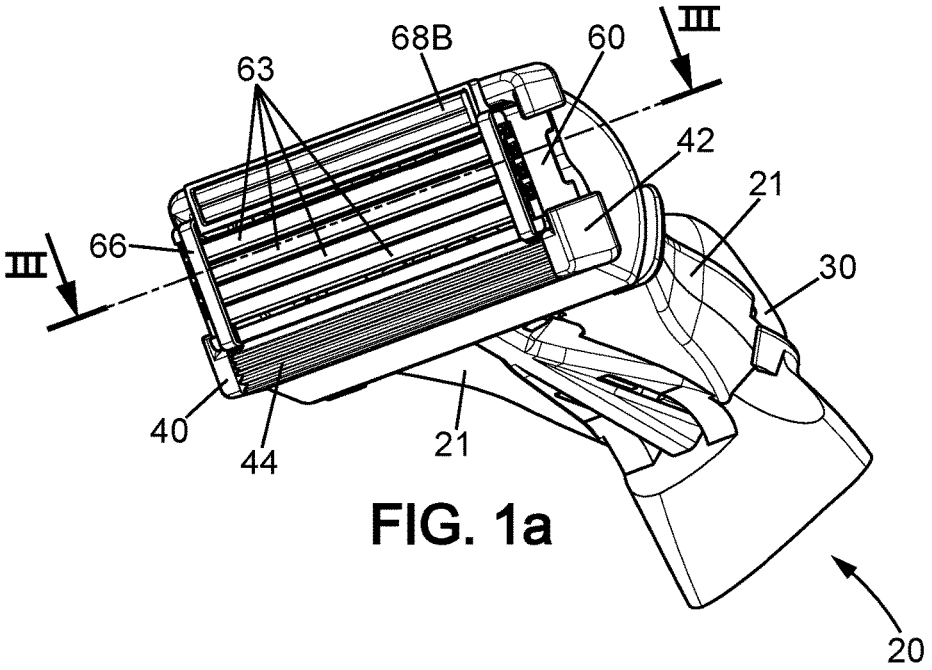
FIG. 1 *a* shows an overall view of the shaver from the front side
FIG. 1*b* shows an overall view of the shaver from the back side
FIG. 1*c* shows a cross-section of the shaver along line Ic
Figure 1B:
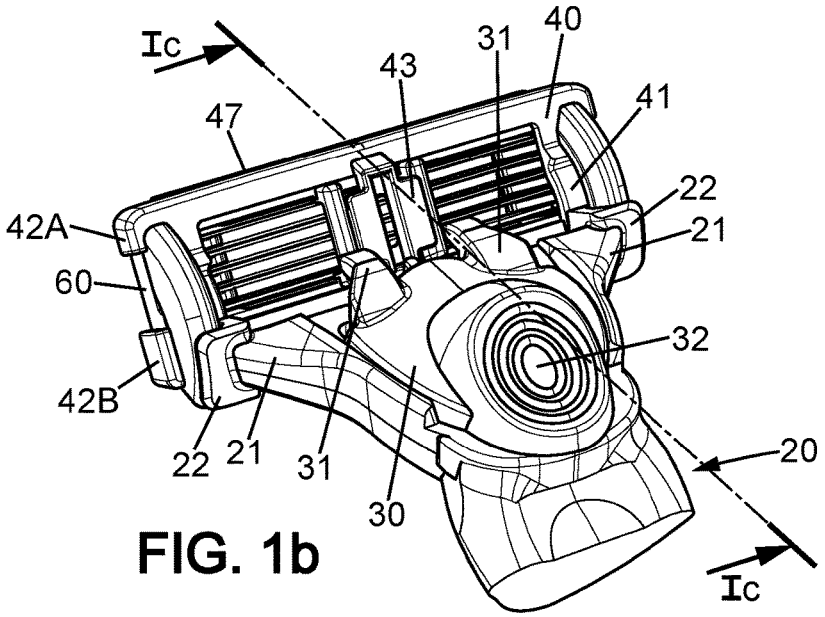
Figure 1C:
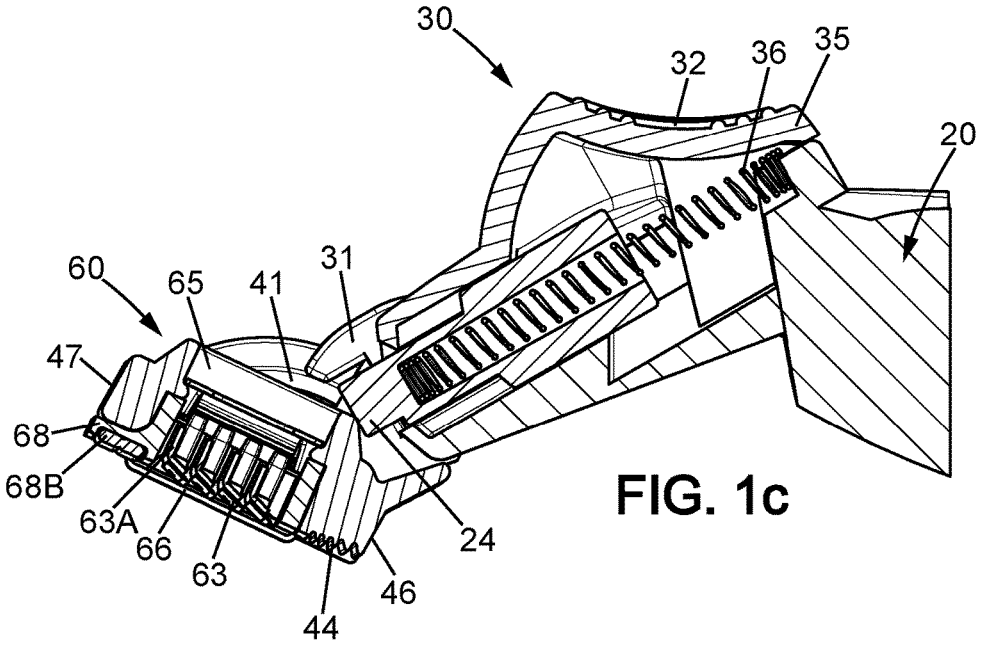

FIGS. 1*a* to 1*c* show an example of a shaver according to the present invention. The shaver comprises a handle 20, a shaver head 40 and a cartridge 60, which accommodates one or more blades 63. On the example shown on the Figures, there are four blades. However, the cartridge may also use more or less blades.

Figure 5A:
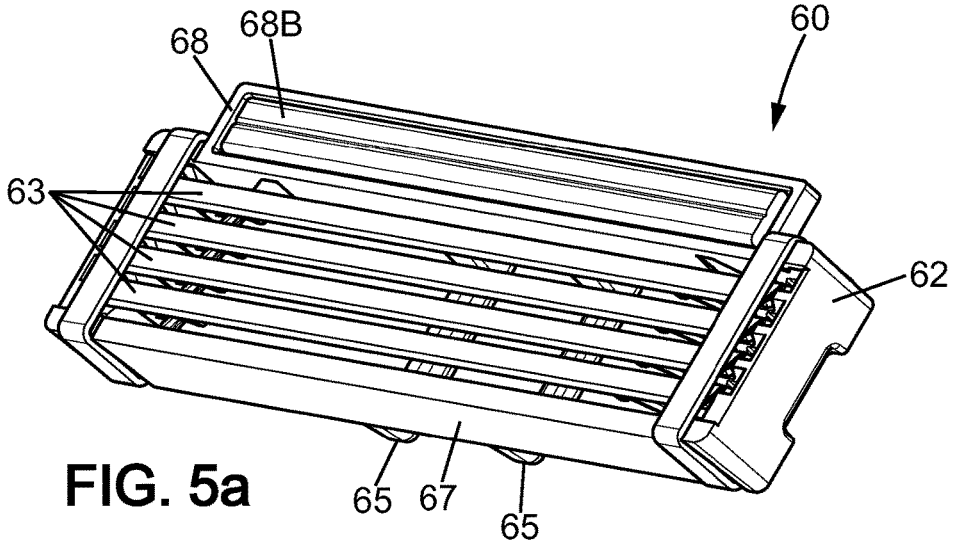
FIG. 5*a* is a front view of the cartridge
Figure 5B:
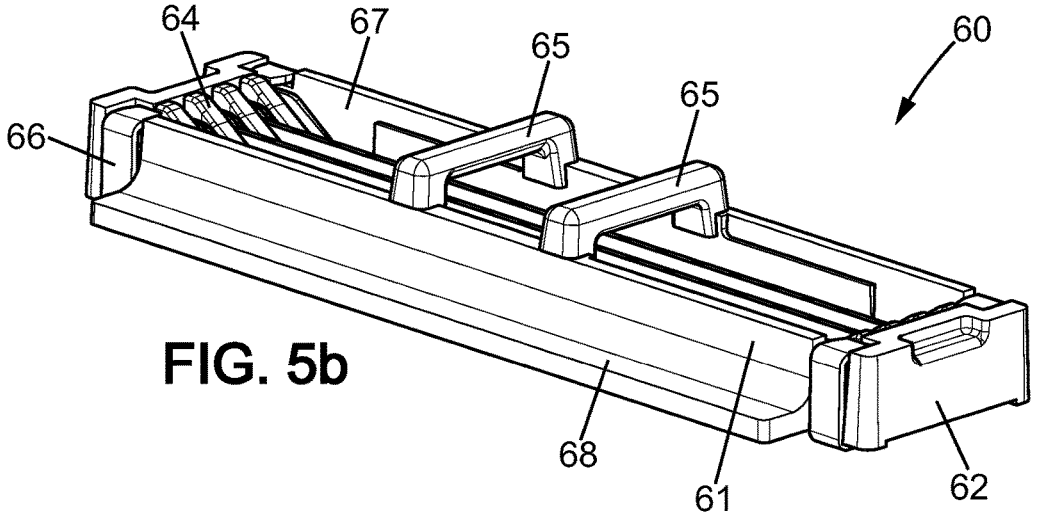
FIG. 5*b* shows the cartridge
Figure 5C:
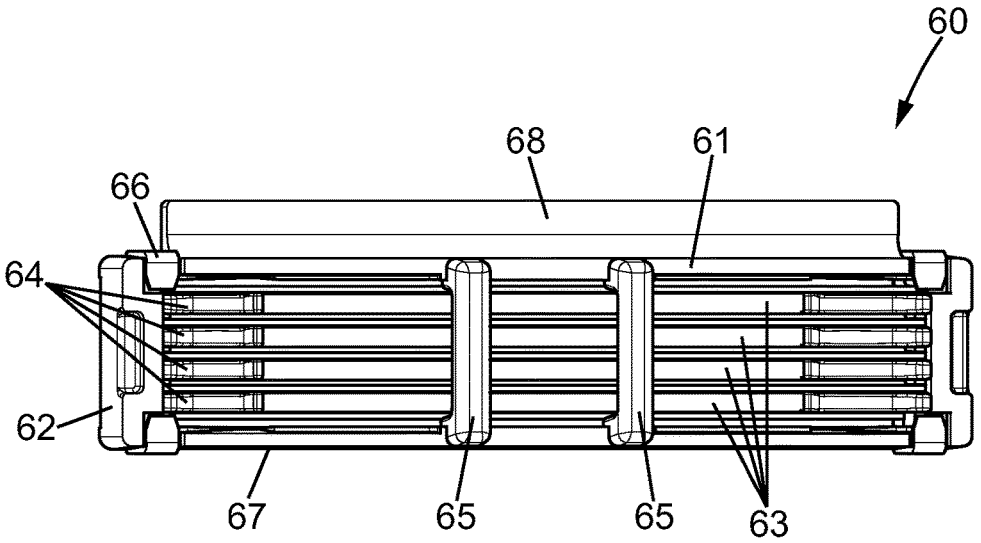
FIG. 5*c* is a back view of the cartridge

The cartridge (FIGS. 3, 5*a* and 5*b*) 60 is formed as a frame with a top wall 61, two lateral walls 62, bottom wall 67 and a back structure 48 (shown in detail on FIGS. 5*b* and 5*c*). The top wall 61 and the bottom wall 67 are elongated and connected by the lateral walls 62. The frame of the cartridge 60 may be molded out of plastic; preferably, the frame is one-piece. The top wall 61 may further comprise a shaving aid retention member 68. The shaving aid retention member 68 preferably protrudes upwards from the top wall 61. The shaving aid retention member 68 accommodates a shaving aid 68B. The blades 63 extend between the lateral walls 62, parallel to the top wall 61 and the bottom wall 67. The blades 63 may be made from bent sheet metal, or, preferably, they may be straight and supported with blade supports 63A. The blades 63 and/or the blade supports 63A are then accommodated in seats provided in the lateral walls 62. Moreover, the blades may for instance be placed movably. The lateral walls 62 may be provided with elastic fingers 64, extending towards the insides of the cartridge frame, in a direction parallel to the blades 63, and supporting movably the blades 63. The blades 63 may be held in the cartridge 60 by a pair of bent metal strips 66, which encircle the ends of the blades 63 and thus hold them in place. In the top wall 61, lying generally in a plane defined by the blade edges, a shaving aid 68B may be provided. In other embodiments, the blades may be fixed.

Figure 2A:
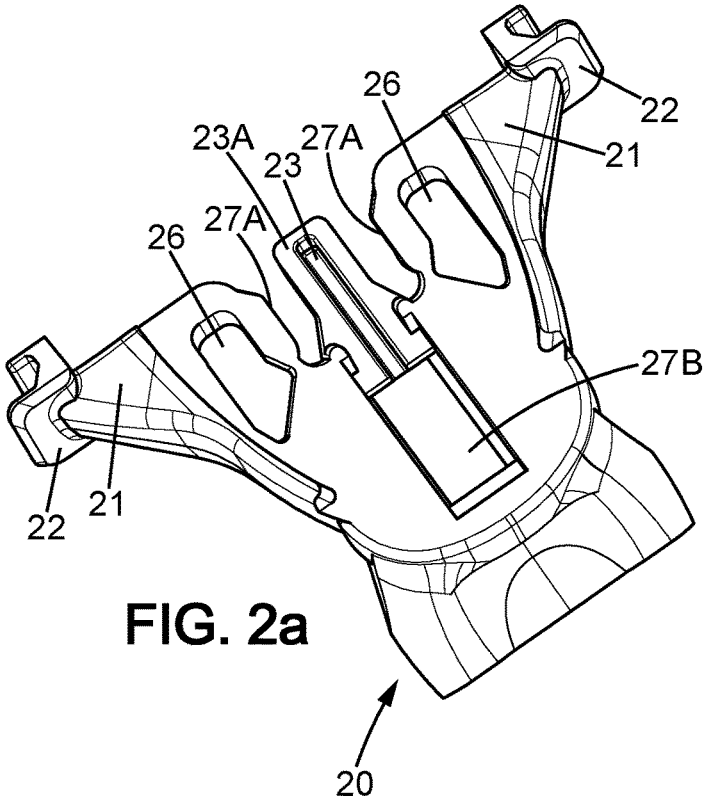
FIG. 2*a* shows a front portion of the handle
Figure 2B:
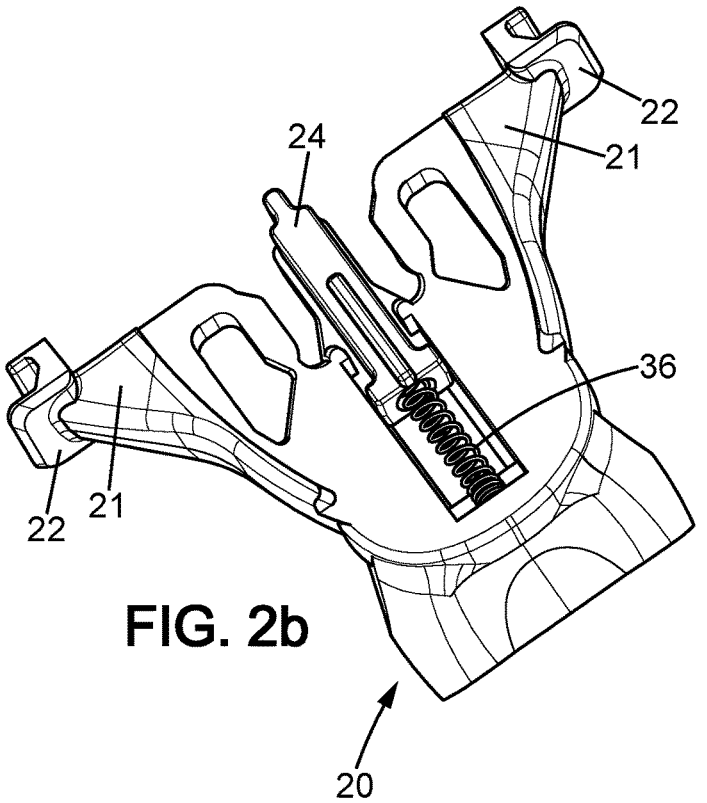
FIG. 2*b* shows a front portion of the handle with a cam follower and a spring

The handle 20 has an elongated handgrip portion (not shown) which may be provided with features that enhance grip of the user and help prevent slipping, such as ribs, pegs, elastomeric parts and the like. The handle 20 is preferably molded out of a plastic material. The handle 20 is terminated in two yokes 21 extending from the handle, as shown on FIGS. 2*a* and 2*b*. The yokes 21 end in a mounting portion, which may be provided in a form of shell bearings 22. The shell bearings 22 cooperate with complementary depressions 41 provided on the shaver head 40. The shell bearings 22 and the complementary depressions 41 together enable the shaver head 40 to pivot about an axis parallel to the length of the blades 63. Alternatively, the shell bearings 22 may be replaced by hinges, pins or other pivoting means; the shaver head 40 may also be attached to the handle 20 without any pivoting means. Here, only the pivoting head will be described.

Between the yokes 21, there is positioned a loop 23A, the loop 23A defining a gap 23. The gap 23 accommodates a cam follower 24. The cam follower cooperates with a bottom portion 43A of an elastic member holder 43, provided on the shaver head 40, therefore enabling the shaver head 40 to be returned to the neutral position when the shaver head 40 is pivoted. The cam follower 24 is operated by a coil spring 36, which is preferably made of metal.

Figure 3:
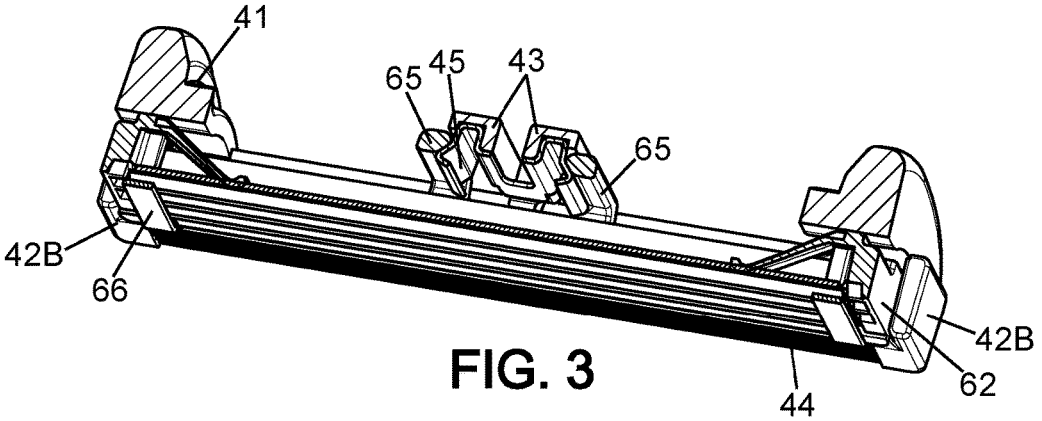
FIG. 3 shows a cross-section of a cartridge inserted into the shaver head along line III
Figure 4A:
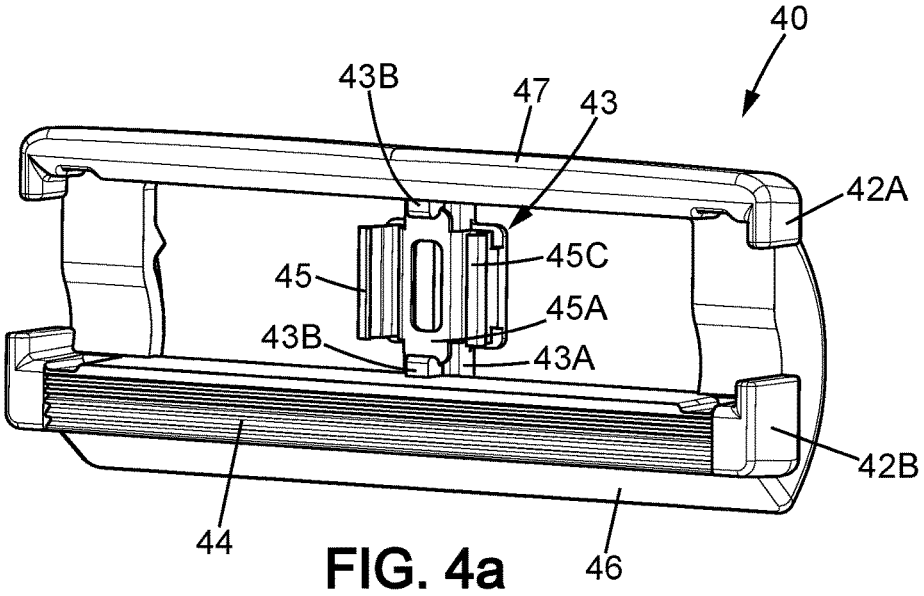
FIG. 4*a* shows a shaver head without the cartridge as seen from the front
Figure 4B:
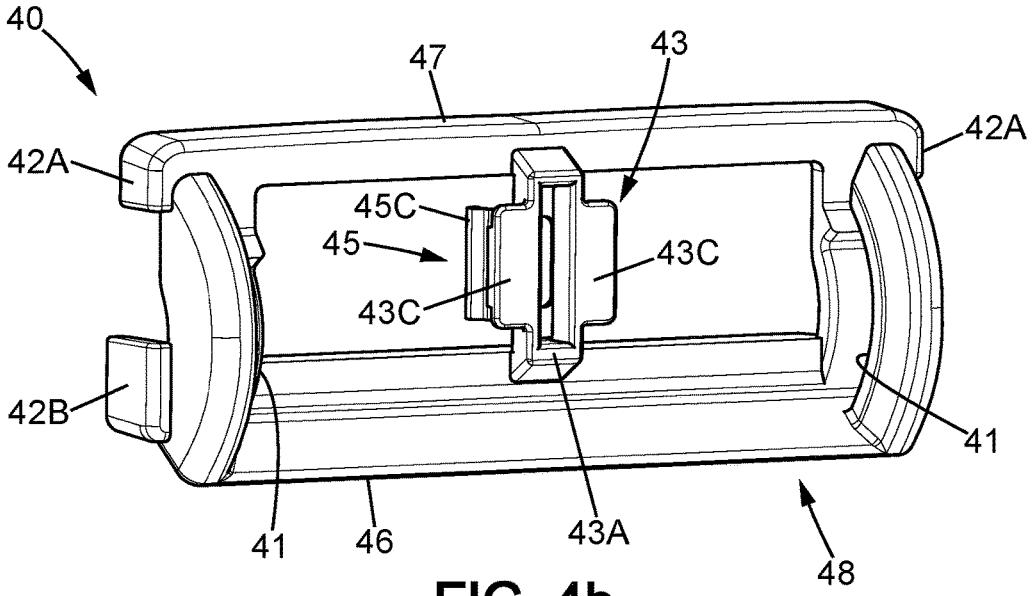
FIG. 4*b* shows a shaver head without the cartridge as seen from the back

An example of a shaver head 40 is shown on FIGS. 3, 4*a* and 4*b*. The shaver head comprises a top wall 47, a back structure 48, a bottom wall 46 and a pair of top lateral walls 42A and a pair of bottom lateral walls 42B. The bottom wall 46 may include a skin engaging element or a guard 44, preferably made in an elastomeric material. The back structure 48 comprises depressions 41, which accommodate shell bearings 22, positioned at the end of the handle 20. On the back structure 48, there is also an elastic member holder 43. The elastic member holder 43 preferably connects the top wall 47 and the bottom wall 46, extending from the bottom wall 47 to the bottom wall 46 preferably in the middle of the shaver head. The elastic member holder 43 comprises a bottom portion 43A, a holding portion 43B, and a pair of laps 43C.

The elastic member holder 43 holds an elastic member 45. The bottom portion of the elastic member holder 43A cooperates with the cam follower 24. The holding portion 43B is preferably provided in a form of pegs, protruding symmetrically from the top wall 47 and the bottom wall 46, respectively. The holding portion 43B holds a flat central portion 45A (see FIGS. 6*a* and 6*b*) of the elastic member 45.

The shaver head 40 forms a seating where the cartridge 60 can be accommodated (detail of such seating is shown on FIG. 4*a*). The cartridge 60 is preferably inserted from the front, i.e. from a direction perpendicular to the direction of shaving.

Once the cartridge 60 is inserted into the shaver head 40, it encounters an elastic member 45. The elastic member may be formed as an integral part of the elastic member holder 43. It may also be provided as a separate part, accommodated in the elastic member holder 43. In the example shown on the Figures, the elastic member 45 is provided as a separate leaf spring, accommodated in the elastic member holder 43.

Figure 6A:
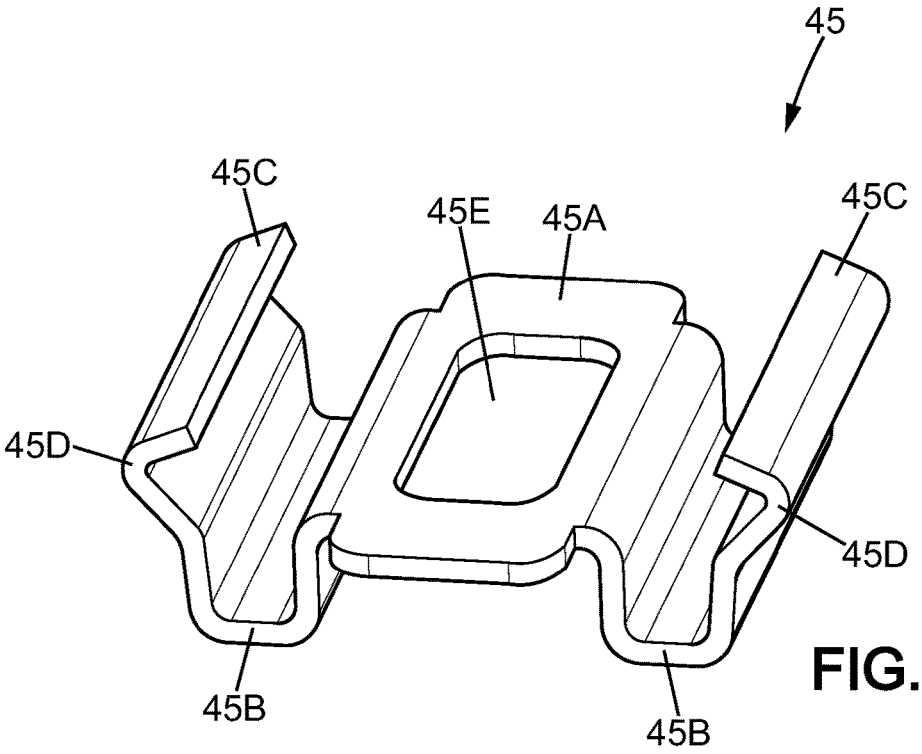
FIG. 6*a* shows an overall view of the elastic member
Figure 6B:
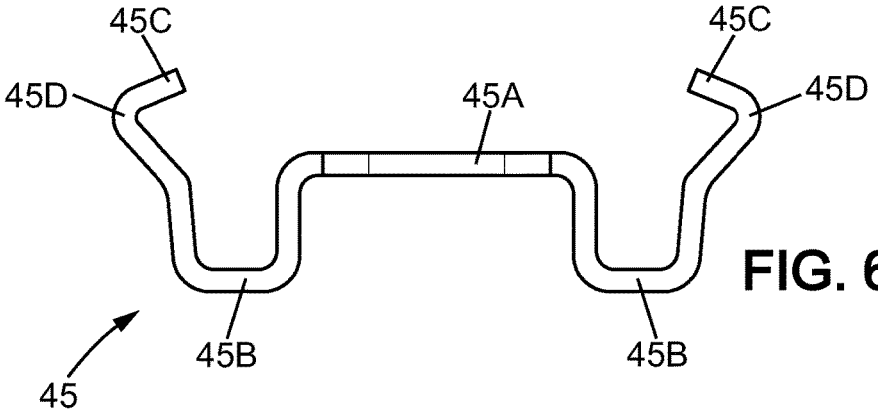
FIG. 6*b* shows a lateral view of the elastic member

One example of the leaf spring is shown on FIGS. 6*a* and 6*b*. The elastic member/leaf spring 45 as shown on the Figures is preferably made of metal, therefore being resilient and not easily destroyed, but may be made in any other suitable material, such as plastic or material with elastic properties.

The elastic member/leaf spring 45 comprises a flat central portion 45A. The flat central portion may have an overall shape of a rectangle, as shown on the Figures. The flat central portion can be also provided in other shapes, such as simple geometrical shapes and their combinations. When inserted to the elastic member holder 43, the flat central portion 45A preferably extends from the top wall 47 to the bottom wall 46 of the shaver head 40, and is held in its shorter sides by the holding portion 43B of the elastic member holder 43. The flat central portion 45A preferably further comprises a hole 45E. The hole 45E may help to save material and/or improve elastic properties of the elastic member/leaf spring 45. It may be helpful to increase the wash through of the head.

From the flat central portion 45A, a pair of symmetrical curved wings protrudes. The wings preferably take an overall shape of a U, with a bottom portion 45B, an extending part 45D, and an end portion 45C. The bottom portion 45B is positioned generally under a plane defined by the flat central portion 45A. When the elastic member/leaf spring 45 is assembled with the shaver head 40, the bottom portion 45B protrudes in a direction towards the back structure 48 of the shaver head 40. The bottom parts 45B rest against the laps 43C, thus being supported by the laps 43C. The laps 43C help to prevent extensive deformation of the elastic member/leaf spring 45. The extending part 45D and the end part 45C form together a generally C-shaped protrusion, protruding generally in a direction parallel to a plane defined by the flat lateral portion 45A.

The extending part 45D and the end part 45C of the wings are positioned generally above the plane defined by the flat central portion 45A. When the elastic member/leaf spring 45 is assembled with the shaver head 40, the extending part 45D and the end part 45C both protrude in a direction towards the cartridge. These parts are adapted to encounter the back structure of the cartridge 60 and thus hold the cartridge 60 at its place.

In an embodiment shown on FIGS. 5*a* to 5*c*, the back structure of the cartridge 60 is provided with a pair of holders 65, which can be encountered by the extending part 45D and the end part 45C of the elastic member/leaf spring 45. The holders 65 are preferably formed as parallel bars, extending from the top wall 61 towards bottom wall 67 as seen on FIGS. 5*b* and 5*c*. Between the holders 65 and any other element of the cartridge 60 such as blades 63 or their supporting structures, there is a free space.

Once the cartridge 60 is inserted, the holders 65 are encountered by the extending part 45D and the end part 45C of the elastic member/leaf spring 45. The holders 65 are snap-fitted with the extending part 45D and the end part 45C of the elastic member/leaf spring 45, and thus the cartridge 60 is retained in its seating in the shaver head 40.

Once the cartridge 60 is inserted into the shaver head 40, the cartridge 60 preferably does not perform any movements with respect to the shaver head 40. The shaver head 40 is attached pivotally to the handle 20; preferably, the pivoting means 22, 41 are provided on the shaver head 40 and on the handle 20, but not on the cartridge 60.

The above described mechanism, which uses the elastic member/leaf spring 45 provided on the shaver head 40 and the holders 65 provided on the cartridge 60, brings about several advantages. The only replaced component is the cartridge 60, which in itself does not hold any additional features (such as pivoting means and the like). Therefore the price of the cartridge 60 may be lowered and the manufacturing process thereof may be simplified; as the shaver head 40 and the handle 20 are not replaced, they may be manufactured as being more robust while keeping the price reasonable. Especially, the pivoting means provided to perform the pivoting movements are not replaced with the cartridge and thus may be manufactured more reliable. Moreover, the snap-fitting mechanism is both easy to manufacture and easy to operate. The simplified design of the cartridge 60 may be further beneficial with regards to sustainability, as the cartridge 60 may be washed with reduced amount of water.

Figure 7A:
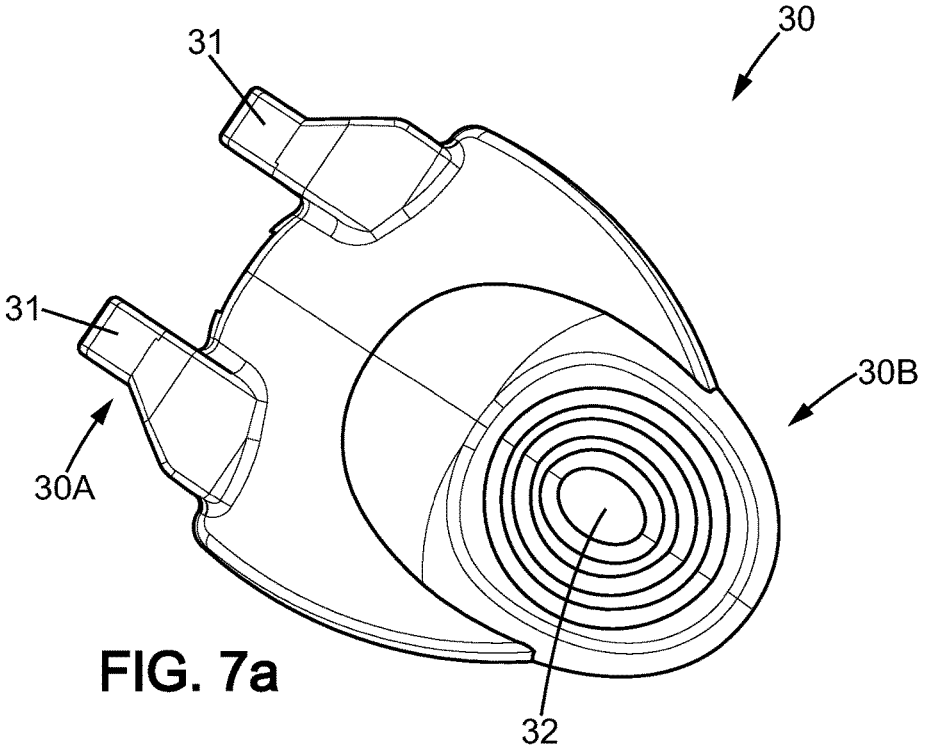
FIG. 7*a* shows a top side of the button
Figure 7B:
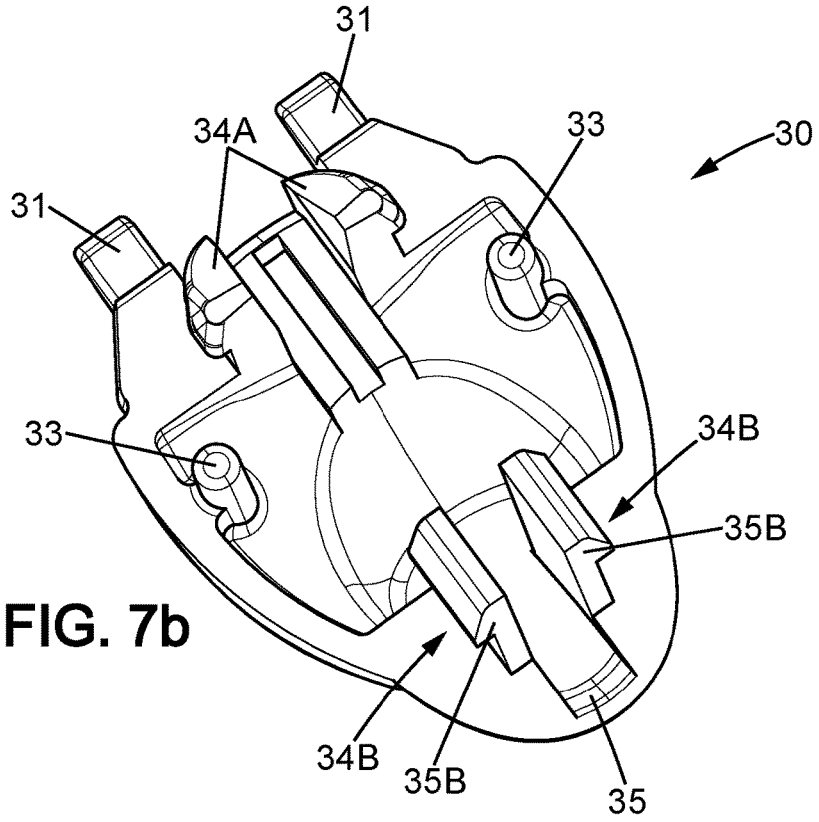
FIG. 7*b* shows a bottom side of the button
Figure 7C:
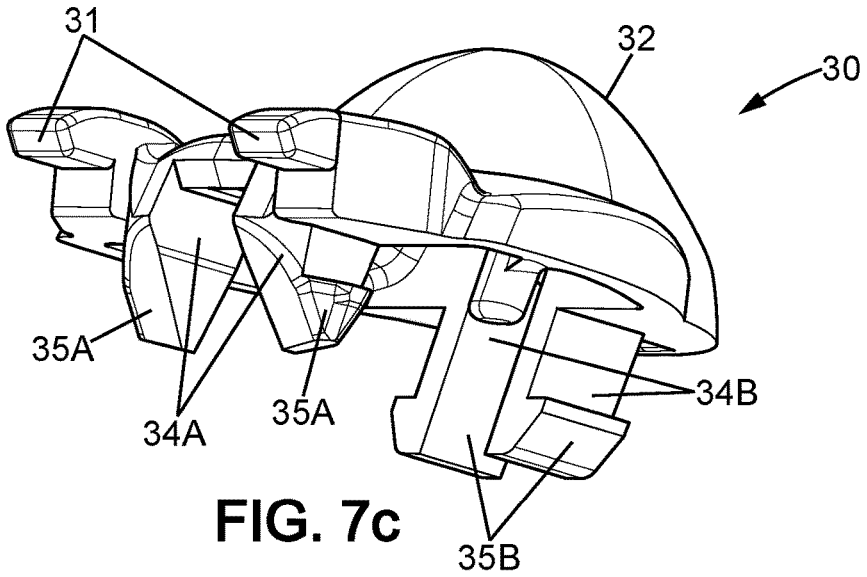
FIG. 7*c* shows an overall view of the button On the different Figures, the same reference signs designate like or similar elements.

The top part of the handle 20 adjacent the shaver head 40 is also provided with a button 30 (see FIGS. 7*a* to 7*c*). The button 30 has a front end 30A and a rear end 30B. The button 30 is slidable in a direction generally parallel to the longitudinal direction of the handle 20. To ensure sliding of the button 30, two pair of guides 34A and 34B are provided on the part of the button 30 that is adjacent to the handle 20. The guides 34A, 34B encounter the guide trails 27A, 27B provided on the front portion of the handle 20; preferably, the guides 34A, 34B are provided with a bent lower portions 35A, 35B so as to ensure that they do not disengage from the respective guide trails 27A, 27B. In this way, the guides 34A, 34B, when in cooperation with guide trails 27A, 27B, provide the button 30 with sliding in a direction generally parallel to the length of the handle 20, prevents the button 30 from moving elsewhere, and also prevents the button 30 from disengaging from the handle 20.

The button 30 comprises a finger receiving region 32, provided on the top part of the button 30. As can be seen on FIG. 7*a*, the finger receiving region 32 may be equipped with features that help to prevent slipping of user's fingers. Once the user encounters the button 30 with his/her finger, s/he may push the button 30 in a direction towards the shaver head 40. To return the button 30 to its initial position, the button 30 is provided with a coil rest 35, which is positioned at the rear end 30B of the button 30, adjacent the handle 20. The coil rest 35 cooperates with the coil spring 36. When the button 30 is pressed by the user, the coil spring 36 is compressed, and once the button 30 is released, the coil spring 36 returns the button 30 to its original position.

The button 30 further comprises a pusher 31. The pusher 31 is located in the front end 30A of the button, adjacent the shaver head 40. The pusher 31 takes a form of a pair of projections which extend from the button 30 in a direction of the shaver head 40. Preferably, the projections of the pusher 31 are located opposing the holders 65, so that the holders 65 may be easily reached by the pusher 31.

Once the user wishes to replace the cartridge 60, s/he pushes the button 30 and the cartridge 60 is disengaged. More specifically, the pusher 31 presses the holders 65. The holders 65 press the extending parts 45D of the wings of the elastic member/leaf spring 45. The wings of the elastic member/leaf spring 45 thus deform and the cartridge 60 is released and urged away from the shaver head 40.

In this way, the user does not have to touch the cartridge 60 by his/her fingers and the risk of cutting the user's fingers with the blades 63 is then reduced.

Moreover, as can be seen on FIGS. 7*b* and 7*c*, the button 30 comprises a pair of safeguards 33. The safeguards 33 generally take a form of pins protruding downwards from the button 30. The handle is adapted to receive these safeguards 33 in grooves 26, carved in the handle 20. The safeguards 33 can slide back and forth in the grooves 26, and given the shape of the grooves, they prevent the yokes 21 from being accidentally moved closer together. When the yokes 21 cannot be moved closer together, the risk of the yokes accidentally releasing the shaver head as a whole is reduced, thus reducing risk of injury of the user.

The invention claimed is:

1. A shaver comprising:

a handle having a mounting portion, a shaver head attached to the mounting portion, the shaver head having a back structure, a removable cartridge comprising at least one frontward extending blade opposite the back structure of the shaver head, and a pair of holders, the cartridge being adapted to be seated in the shaver head and removed from the shaver head, and at least one elastic member provided on the back structure of the shaver head, the at least one elastic member comprising a flat central portion and a pair of a curved wings protruding from the flat central portion, wherein the curved wings of the at least one elastic member are adapted to attach the cartridge to the shaver head by being snap-fitted into the pair of holders of the cartridge.

2. The shaver according to claim 1, wherein the shaver head is attached pivotally to the mounting portion.

3. The shaver according to claim 1, wherein each of the curved wings of the at least one elastic member comprises:

a bottom portion, an end portion, and an extending part, the bottom portion and the end portion protrude from the flat central portion, and the extending part, upon insertion of the cartridge, is snap-fitted to the pair of holders of the cartridge.

4. The shaver according to claim 3, wherein the bottom portion and the end portion of the at least one elastic member is interconnected by the extending part.

5. The shaver according to claim 4, wherein the at least one elastic member is made of metal.

6. The shaver according to claim 5, wherein the at least one elastic member is a leaf spring.

7. The shaver according to claim 6, wherein the handle further comprises a button, the button adapted to encounter the pair of holders to eject the cartridge from the shaver head in a direction perpendicular to the direction of shaving.

8. The shaver according to claim 7, wherein the back structure of the shaver head further comprises an elastic member holder, the extending part of the curved wings being adapted to encounter the pair of holders of the cartridge wherein the elastic member holder is adapted to accommodate and support the at least one elastic member.

9. The shaver according to claim 8, wherein the shaver head further comprises a bottom wall and a guard member, the guard member being positioned adjacent to the bottom wall.

10. The shaver according to claim 9, wherein the handle further comprises a slidable button, the button comprising a pusher, the pusher being adapted to encounter the pair of holder to release the snap-fit of the extending part of the cartridge from the shaver head.

11. The shaver according to claim 10, wherein the cartridge further comprises a top wall and a bottom wall, wherein the pair of holders extends between the top wall and the bottom wall.

12. The shaver according to claim 11, wherein the pair of holders are provided in a form of a pair of parallel bars.

13. The shaver according to claim 11, wherein the cartridge further comprises a shaving aid, the shaving aid being provided in the top wall.

14. The shaver according to claim 13, wherein the at least one blade is mounted movably.

15. A head and handle assembly for a shaver comprising:

a handle having a mounting portion, a shaver head attached to the mounting portion, the shaver head being adapted forwardly to seat a cartridge, the shaver head having a back structure, and an elastic member provided on the back structure of the shaver head, the elastic member comprising a flat central portion and a pair of curved wings protruding from the flat central portion, wherein the curved wings of the elastic member are adapted to attach the cartridge to the shaver head by being snap-fitted into a pair of holders of the cartridge.

16. The head and handle assembly according to claim 15, wherein the shaver head is attached pivotally to the mounting portion.

17. The head and handle assembly according to claim 16, wherein each of the curved wings of the elastic member comprises:

a bottom portion, an end portion, and an extending part, wherein the bottom portion and the end portion protrude from the flat central portion.

18. The head and handle assembly according to claim 17, wherein the bottom portion and the end portion of the elastic member are interconnected by the extending part.

19. The head and handle assembly according to claim 18, wherein the shaver head further comprises a bottom wall and a guard member, the guard member being positioned adjacent the bottom wall.

* * * * *